United States Patent [19]

Littwin et al.

[11] Patent Number: 4,639,821

[45] Date of Patent: Jan. 27, 1987

[54] DEGAUSSER/DEMAGNETIZER

[75] Inventors: Kenneth M. Littwin, Chicago; Joseph A. Armond, River Grove; Gabriel R. Buky; Fred Patrick, both of Chicago, all of Ill.

[73] Assignee: Electro-Matic Products Co., Chicago, Ill.

[21] Appl. No.: 753,597

[22] Filed: Jul. 10, 1985

[51] Int. Cl.[4] ..... H01F 13/00

[52] U.S. Cl. ..... 361/151

[58] Field of Search ..... 361/149, 151

[56] References Cited

U.S. PATENT DOCUMENTS 3,702,906 11/1972 Camras ..... 361/151 X 4,423,460 12/1983 Jackson et al. ..... 361/151

FOREIGN PATENT DOCUMENTS 612427 6/1978 U.S.S.R. ..... 361/149

*Primary Examiner*—Michael L. Gellner

*Attorney, Agent, or Firm*—Paul H. Gallagher

[57] ABSTRACT

The articles to be degaussed are carried along on a conveyor under which is a magnet rotating on an axis extending through the conveyor and the articles.

13 Claims, 7 Drawing Figures

DEGAUSSER/DEMAGNETIZER

FIELD OF THE INVENTION

The invention resides in the field of degaussing. Degaussing is basically the same as demagnetizing, but in the industry involved, the term degaussing is generally applied to tapes used in recording. In degaussing, as in demagnetizing, the end objective is to remove the magnetism from an object that was previously magnetized.

OBJECTS OF THE INVENTION

A broad object of the invention is to provide degaussing apparatus and method, which is particularly effective in degaussing tapes wound in reels, as well as other objects.

A further object is to provide degaussing apparatus and method of the foregoing character that utilizes a rotating magnet, in performing a degaussing step, whereby to infinitely vary the angles at which the magnetic field is applied to the object to be degaussed.

Another object is to provide degaussing apparatus and method of the foregoing character, which provides the additional advantages of increasing the speed at which the objects can be degaussed, and ease and greater control effect with which the objects can be carried along on a conveyor in the degaussing operation.

Still another object is to provide apparatus and method of the foregoing character, which provides further advantages of providing greater control in applying the magnetic field to the objects to be degaussed.

While the invention relates to degaussing, it is also included in the broad field of demagnetizing. The term degaussing is most often used, instead of demagnetizing, in connection with magnetic tapes. These tapes are used for recording magnetic signals in the electronics field, including radio, TV, etc. The tapes are of great length, and are rolled in spirals, and in degaussing them, instead of running the tapes through the degaussing field linearly, the complete spiral tapes are put through the degaussing field and degaussed in bulk. Many problems have occurred in the degaussing field, in eliminating or erasing the last vestiges of the signals in the tape. Due to the spiral shape of the tape, the directions of the original magnetizing are infinite, because of the continuous curved shape of the individual linear elements of the tape. Heretofore it has been extremely difficult to eliminate such last vestiges of signals, and very often portions of the signals, or noise, remained at certain predetermined positions, such for example at locations relatively 180° apart.

In the present instance all of the signals are effectively erased by the basic phenomenon of providing a rotating or spinning magnetic field.

Reference is now made to the detail mechanical construction of an apparatus embodying the principles of the invention as referred to above. For simplicity and convenience the apparatus will be referred to herein as a degausser.

Figure 1:
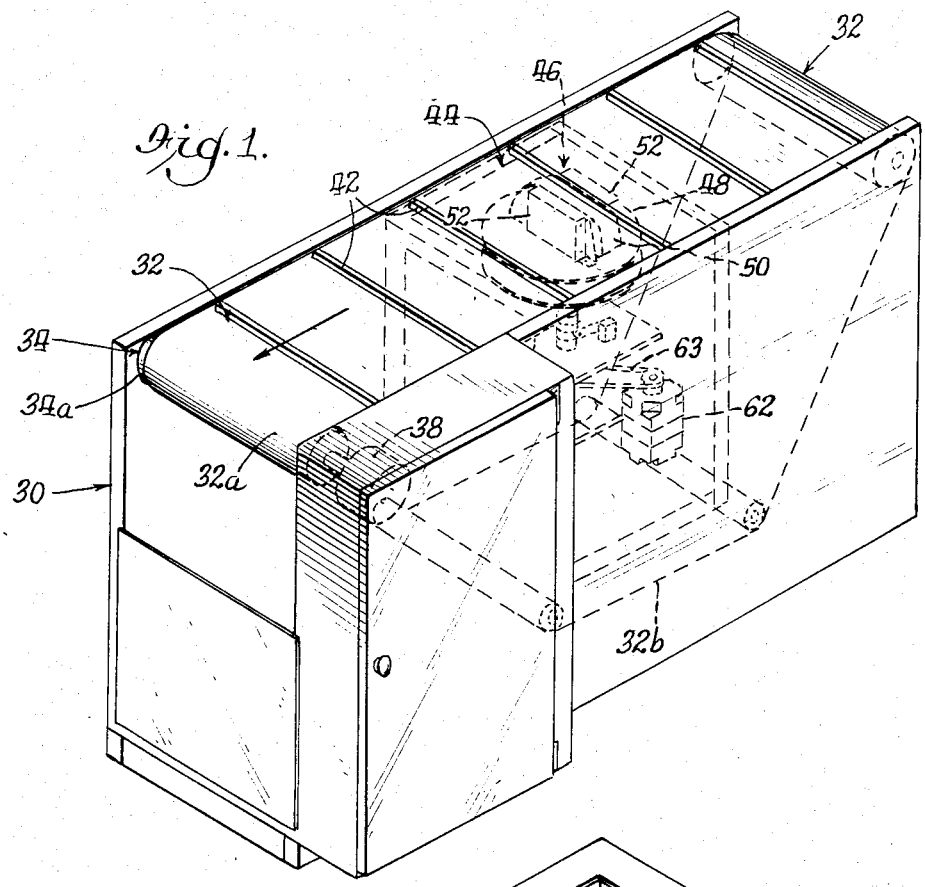
FIG. 1 is a perspective view showing the principal components of the degaussing apparatus made according to the present invention.
Figure 2:
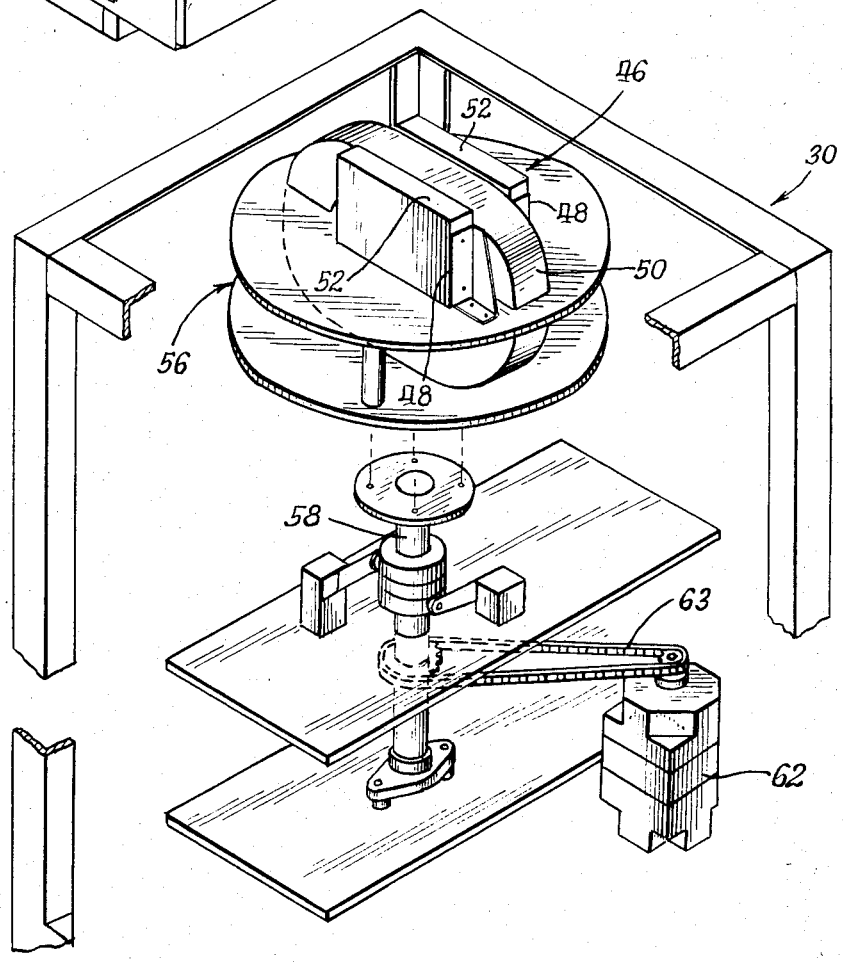
FIG. 2 is a perspective view showing certain principal operating components of the apparatus.

FIG. 1 shows a stand 30 of suitable kind into which is built a conveyor 32 trained over pulleys 34, one of which, e g. 34*a* is a driving pulley driven by a suitable motor 38. The conveyor 32 includes an upper run 32*a* and lower run 32*b*. The articles to be degaussed are placed on the upper run, which in the present case are tapes 40 rolled in spiral form. The mechanical construction of the conveyor may be as desired, and may include cleats 42 for physically engaging the tapes and carrying them along. The motor 38 is of variable speed character, for correspondingly varying the speed of the conveyor and the rate of carrying the tapes thereby. The stand 30 has a degaussing station 44, referred to for convenience, in which the articles, or tapes, are carried through and effectively degaussed.

The apparatus or unit represented in FIG. 1 is designed for providing various practical features, as desired. The tapes 40 to be accommodated may be of various sizes, such as of up to 15" in diameter and the conveyor 32 is dimensioned to accommodate the tapes of the sizes involved. For practical purposes the conveyor may be of a width approximately the diameter of the largest tapes, or wider, and the degaussing magnet utilized in the apparatus is correspondingly dimensioned according to the width of the conveyor.

Figure 3:
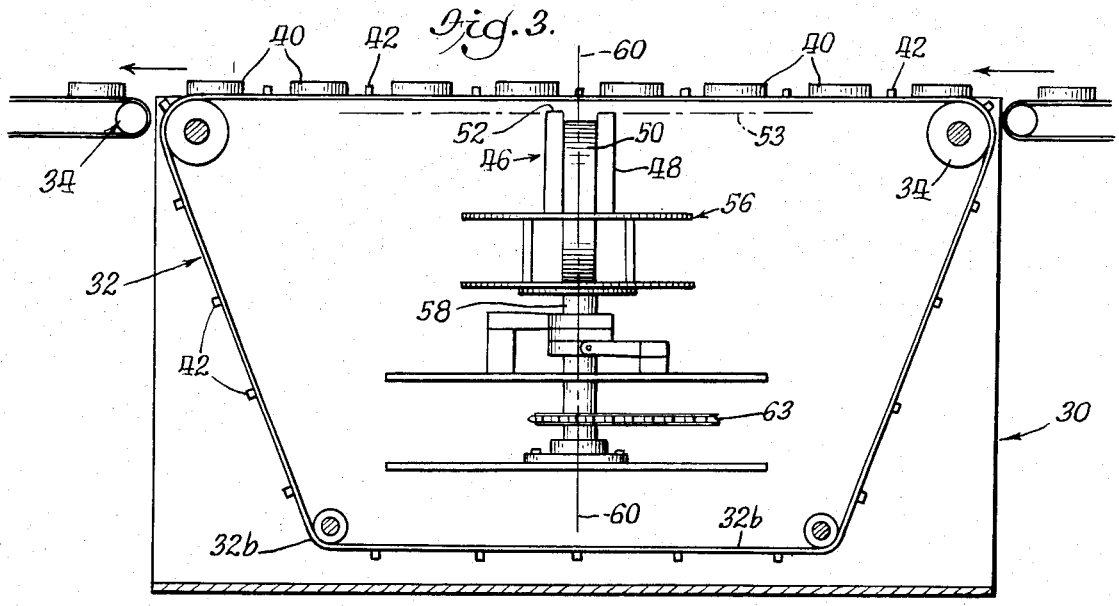
FIG. 3 is a side view of the apparatus, somewhat diagrammatic in nature.
Figure 4:
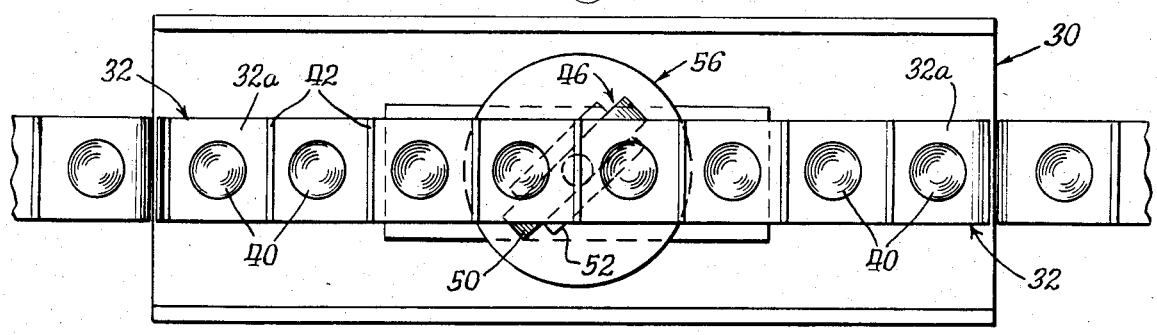
FIG. 4 is a top view of FIG. 3.

Mounted in the stand 30 is an electromagnet 46 for performing the degaussing operation, positioned directly below the degaussing station 44, and including a core 48 and a winding 50. The magnet is constructed to provide the desired characteristics for the degaussing function as referred to hereinbelow. The core 48 is U-shape, having parallel poles 52 with end surfaces lying in a plane 53 (FIG. 3) disposed horizontally and spaced under the conveyor, as referred to again hereinbelow.

The magnet 46 is mounted on a rotatable table 56 having a vertical shaft 58, the axis of which is indicated at 60. The table, and thus the magnet, is rotated by a suitable motor 62 of variable speed character. The mechanical construction of the table and the drive means may assume any convenient form, the latter being a belt 63.

The electrical connection to the magnet 46, for energizing the magnet, includes a unit 64, having collector rings 66, and brushes 68 operably engaging the collector rings.

In the operation of the apparatus, the tapes are placed on the upper run 32*a* of the conveyor 32 and carried through the degaussing station 44. As a statement of the general operation of the apparatus, the articles to be degaussed or demagnetized, are carried through the field of the magnet, and as they recede therefrom, the specific degaussing step is performed. The electro-magnet is of AC character, and at each reversal in each half cycle, the polarity of the magnetism in the article is reversed, and as the article recedes from the field, it passes through successively weaker portions of the field, until the magnetism is completely dissipated.

In degaussing operations utilized heretofore the magnetic field, working on the articles to be degaussed, caused a pulling or dragging effect which caused them to be shifted or moved on the conveyor, many times impairing the action of carrying them along by the conveyor. It was necessary therefore to provide the cleats 42 for engaging the articles and positively moving them along, against the effects of the magnetic field. In the present case such disadvantageous effects are eliminated or minimized, but the same conveyor as used heretofore may be conveniently used in connection with the present apparatus.

Figure 5:
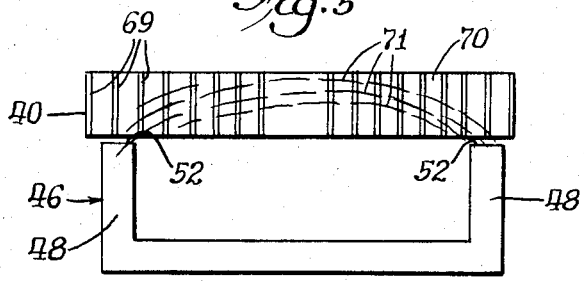
FIG. 5 is a schematic representation, in sectional view, of a tape in position for degaussing, and showing the magnet in relation thereto.
Figure 6:
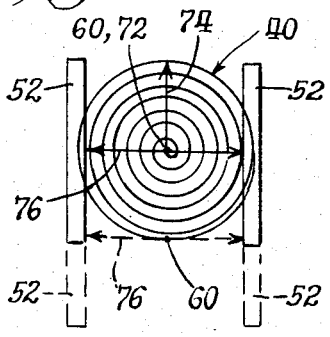
FIG. 6 is a diagrammatic representation of a tape in spiral form showing the poles of the magnet forming the degaussing field.
Figure 7:
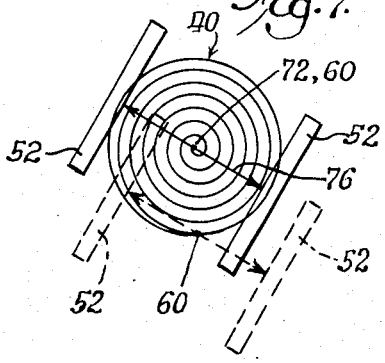
FIG. 7 is a view similar to FIG. 6 but showing the magnet poles at different positions.

FIGS. 5–7 diagrammatically show the magnetic field applied to the tape, and its direction therein. In FIG. 5 for example the tape 40 is shown in section, as viewed in radial direction, but in highly exaggerated form, showing the turns 69 thereof spaced apart in direction generally radially. In this figure, the field of the magnet 46 is indicated at 70, including individual lines of force 71. This figure shows the lines 71 extending generally diametrically of the tape, penetrating the turns of the tape perpendicularly. However this condition or position is encountered only momentarily, in a constantly changing condition in which the lines penetrate the turns in infinite directions as referred to again hereinbelow.

For purposes of convenience, the tape will be referred to as having an axis 72 (FIGS. 6, 7), and a radial direction or radius 74. Although these terms apply more accurately to a circle, they are used in the spiral of the present instance for convenience.

Referring to FIG. 6, the poles 52 are shown in full lines in a position selected at random. Extending between the poles 52 is a line, or double headed arrow line, 76, representing the magnetic field extending between the poles. This field of course extends the full width of the poles, i.e., in directions transverse to the line 76, and more, but the single line is represented and utilized here for convenience. The position of the poles 52 in FIG. 6 happens to be that in which the magnetic field extends diametrically of the tape and the axis 60 of the magnet coincides with the axis 72 of the tape. The rate of rotation or spinning of the magnet is great relative to the longitudinal movement of the conveyor, and it rotates many times throughout the extent of travel represented by the leading and trailing edges of the tape. However in FIG. 6 the two positions of the magnet represent the two positions of the tape travelling along on the conveyor and thus a comparison of the positions of the magnetic field in two different positions of the tape. In the full line position in FIG. 6, the lines of the magnetic field extend diametrically, and on lines parallel to the diameter, and throughout the width of the field, the lines extend through the turns of the tape in different directions at every point along each line, and linearly along the individual turns of the tape. The combined movements, of rotation of the magnet, and linear travel of the tape, provide infinite directions of extension of the lines through the elements of the tape. The dot-dash position of the poles 52 in FIG. 6 presents a contrast to that of the full line position. In the dot-dash line position is also shown the line 76 of the field which extends parallel with the line 76 in the full line position, but in the dot-dash line position it extends through an element of the tape at the periphery, in tangential direction. The myriad of positions between the full line and dot-dash line positions represent the infinite directions in which the lines of the field pass through the tape.

FIG. 7 is a representation similar to FIG. 6 except that the poles of the magnet, in both full line and dot-dash line, while parallel to each other, are at an angle to the corresponding lines in FIG. 6. The comparison between FIGS. 6 and 7 show the variety of change of directions of the lines through the tape due to both linear travel of the tape and rotation of the magnet.

The representation in each FIG. 6 and FIG. 7, shows not only the relative positions at only certain points along the conveyor, but at the same positions of rotation of the magnet. In FIG. 6 the full line position shows the line 76 in a diametrical position while the dot-dash line is displaced linearly, along the conveyor, from the full line, and hence is not in a diametrical position. In this representation, the full line 76 penetrates through each of the turns of the tape, in direct perpendicular direction therethrough, while in the dot-dash line, the line is displaced from a diameter, and thus penetrates through the turns each in a different direction relative to the curvature of that turn. In this case it is of course understood that the condition referred to is only that of the central line 76, but the other lines at the sides thereof penetrate through in different directions.

In FIG. 7 an identical situation is represented, except that the original positions of the line 76 are not in the same direction as in FIG. 6, but at an angle thereto, but as to the direction of penetration through the elements of the tape, they are identical.

It will be understood that in each FIG. 6 and FIG. 7, the magnet will rotate many times during the interval represented by the leading edge and the trailing edge of the tape so that the conditions in either of these figures will have been duplicated many times in one pass of the tape.

The following are various specific examples of construction, dimensions, proportions, and relative positioning, utilized in the apparatus, which are to be considered only practical examples in carrying out the invention and not as limiting.

The upper run **32*a* of the conveyor may be positioned about 2", or less from the pole surfaces of the poles 52**.

The conveyor may travel at speeds of up to 44 feet per minute, depending on various factors, including density of magnetization, mass of the article, and others.

The speed of rotation of the electromagnet in most instances is in the range of 200–500 RPM. It may be as great as 3600 RPM in specific circumstances.

The record tapes encountered in most instances, range between $\frac{3}{4}$" and $1\frac{1}{2}$" in thickness, i.e., axial direction. The apparatus will also accommodate floppy discs which are most often of diameters of between $3\frac{1}{2}$" and 8".

An example of field strength utilized in the electromagnet is between 2,000 and 3,000 gauss.

The apparatus is adapted to use with AC, and the apparatus of the present embodiment is designed for use with AC. However the invention is sufficiently broad to cover DC.

An unusually effective degaussing operation is produced by the rotation of the magnet. The rotation is of relatively high speed as stated above, and in any one orientation of the magnet, such as a specific location of the poles, the magnetizing effect (in the degaussing operation) if of very short duration, with the consequence that the object is not magnetized to any high degree in the direction corresponding to that orientation. It is however magnetized to a certain degree, which is necessary in the degaussing operation, but in the opposite orientation of the magnet, that magnetization that was performed in the first position, is overcome, and it is magnetized in the opposite direction, again to a low level. This eliminates the condition in previously known devices, wherein in each orientation, i.e., the degree of magnetization in each reversal of polarity, is relatively high, and greater force is required to overcome that magnetism of that polarity in the next reversal and produce a magnetism of the opposite polarity. Accordingly the degaussing operation, i.e., the successive steps of producing opposite polarities, is much more rapid. Also as a consequence, less force of the magnetic field is required because of the less work required in each individual rever- sal.

In the use of the present apparatus, another advantage is that the objects or articles are easily carried along by the conveyor. Due to the rapid reversals of the polarity in the magnetic field, there is no persistent drag on the articles as would be the case of magnetism persisting in one direction for longer periods of time. In that case there is a tendency to drag or pull the articles downwardly on the conveyor. In the rapid reversals utilized in the present case, the inertia of the objects prevents any great drag or pull on the articles, with the result referred to above. Because of the less drag, or downward pulling of the articles, less power is required for driving the conveyor.

In the use of the apparatus of the invention, damage to the parts is greatly reduced if not entirely eliminated, because of the less drag produced by the articles on the conveyor, as contrasted with previous devices.

We claim:

1. Degausser apparatus comprising, a conveyor adapted to be moved along a linear path, and having a supporting surface for supporting articles to be degaussed and operable for carrying them along the path, means for so moving the conveyor, a magnet having a fixed magnetic field positioned closedly adjacent said supporting surface with pole surfaces lying in a common plane and its magnetic field extending through said supporting surface and into articles on the supporting surface, the magnet being rotatable bodily about an axis extending through said supporting surface with its magnetic field remaining fixed relative to the magnet, whereby the magnetic field extends through the articles in direction constantly changing corresponding to the rotation of the magnet, and means for rotating the magnet.

2. Degaussing apparatus according to claim 1 wherein, in the relatively reversed positions of the magnet caused by rotation thereof, the polarity of the magnetic field is in correspondingly reversed positions.

3. Degaussing apparatus according to claim 1, wherein, the magnet includes a core having end poles spaced apart on a line transverse to said axis, and the magnetic field extends between said poles in all positions of rotation of the magnet, and thereby through the axis of rotation in all such positions.

4. Degaussing apparatus according to claim 1 wherein, the conveyor and rotating means are movable at such relative speeds that the magnet makes a complete rotation while the axis thereof is within the limits of each article longitudinally of the conveyor.

5. Degaussing apparatus according to claim 4 wherein, the magnet makes a plurality of complete rotations within said limits.

6. Degaussing apparatus according to claim 5 wherein, the rotating means is operable for rotating the magnet on the order of up to 12 times while the axis of the magnet is within the limits of each article longitudinally of the conveyor.

7. Degaussing apparatus according to claim 5 wherein, the rotating means is operable for rotating the magnet at a speed of on the order of from 200 RPM to 500 RPM.

8. Degaussing apparatus according to claim 5 wherein, the conveyor moves and the magnet rotates, both continuously and uninterruptedly.

9. Degaussing apparatus according to claim 8 wherein, the conveyor is operable for progressively carrying the articles beyond the effects of the field of the magnet.

10. Degaussing apparatus according to claim 5 wherein, the rotating means is operable for rotating the magnet at a speed of on the order of up to 3600 RPM.

11. A method of degaussing an article comprising the steps, moving the article along a linear path, and producing a magnetic field on a line lying in a plane parallel to the path, and rotating the magnetic field about an axis extending transversely through the path and said line.

12. A method according to claim 11 and including the step, maintaining the magnetic field in a location in which said axis is positioned between the ends of the magnetic field.

13. A method according to claim 12 and including the step, so rotating the magnetic field so that in all positions thereof it extends through said axis in a diametrical direction relative thereto.

* * * * *